US007159261B2

(12) United States Patent
Carrigan

(10) Patent No.: US 7,159,261 B2
(45) Date of Patent: Jan. 9, 2007

(54) CONVERTIBLE DOCK RAMP

(76) Inventor: Stephen A. Carrigan, 20924 Rio Oro Dr., Cornelius, NC (US) 28031

( * ) Notice: Subject to any disclaimer, the term of this patent is extended or adjusted under 35 U.S.C. 154(b) by 0 days.

(21) Appl. No.: 10/907,556

(22) Filed: Apr. 5, 2005

(65) Prior Publication Data

US 2005/0235437 A1 Oct. 27, 2005

Related U.S. Application Data

(60) Provisional application No. 60/559,070, filed on Apr. 5, 2004.

(51) Int. Cl.
*E06C 1/39* (2006.01)

(52) U.S. Cl. ..... 14/71.1; 14/69.5; 182/1; 182/20

(58) Field of Classification Search ..... 14/69.5, 14/71.1; 182/1, 20; D34/32; 187/200
See application file for complete search history.

(56) References Cited

U.S. PATENT DOCUMENTS

| | | | | |
|---|---|---|---|---|
| 0,298,212 | A | 6/1884 | Knight | |
| 1,215,827 | A | 2/1917 | Lord | |
| 1,419,834 | A | 6/1922 | Fellows | |
| 1,944,159 | A * | 1/1934 | Bailey | 182/1 |
| 2,362,170 | A * | 11/1944 | Swaisgood | 182/1 |
| 3,731,761 | A * | 5/1973 | Glenn | 182/1 |
| 4,168,764 | A | 9/1979 | Walters | |
| 4,848,515 | A * | 7/1989 | Rinke | 182/20 |
| 5,632,357 | A * | 5/1997 | Matre | 187/200 |
| 5,634,440 | A | 6/1997 | Mogck | |
| 5,794,292 | A | 8/1998 | Ricci, Jr. | |
| 5,901,813 | A * | 5/1999 | Orgal | 187/200 |
| 5,937,971 | A * | 8/1999 | Storm | 187/200 |
| 5,950,267 | A | 9/1999 | Ricci, Jr. | |
| 6,425,711 | B1 | 7/2002 | Kiter | |
| 6,681,432 | B1 | 1/2004 | Reinhold | |

FOREIGN PATENT DOCUMENTS

| | | | |
|---|---|---|---|
| WO | 85/01769 | * | 4/1985 |

* cited by examiner

*Primary Examiner*—Gary S. Hartmann
(74) *Attorney, Agent, or Firm*—Adams Evans P.A.

(57) ABSTRACT

A convertible dock ramp has an upper end for being pivotally mounted to a mounting structure, and a lower end for resting on a second structure. The convertible dock ramp includes a pair of spaced-apart side frames each including upper and lower rails; and a plurality of steps each including a tread surface. The steps are pivotally mounted between the side frames such that the tread surfaces remain substantially parallel to each other as the side frames pivot about the upper end. The steps are pivotable between: a ramp configuration in which the tread surfaces collectively form a substantially flat ramp surface; and a stair configuration in which the tread surfaces collectively form a staircase-like structure. A changeover mechanism selectively retains the convertible dock ramp in the ramp configuration or the stair configuration. A safety stair tread deflects upward as needed to prevent trapping a user's foot.

27 Claims, 15 Drawing Sheets

CONVERTIBLE DOCK RAMP

CROSS-REFERENCE TO RELATED APPLICATIONS

This application claims priority to Provisional Patent Application No. 60/559,070, filed Apr. 5, 2004.

BACKGROUND OF THE INVENTION

This invention relates generally to a convertible dock ramp and stair assembly and more particularly to a convertible dock ramp which can be selectively place in a ramp configuration or a stair configuration.

It is often necessary to provide a bridging structure between two other structures, one of which is floating. For example, a gangway may be provided between a ship and a fixed dock, or a ramp may be provided between a fixed pier and a floating dock. As the water level rises or falls, the floating structure changes its height relative to the fixed structure, and accordingly the angle of the bridging structure relative to a horizontal reference plane changes.

A ramp-like structure is easier to traverse a relatively low angles, while a stair-like structure is easier to traverse at more steep angles. In the prior art, this fact is often accommodated by providing a bridging structure having pivotable stair treads which can remain level as the angle of the overall structure changes. Some of these units allow the treads to move into a position creating a ramp at very low angles. While these units provided the desired adjustability, they freely convert from one configuration to the other regardless of a user's wishes. Such units cannot be controlled from a remote location and can therefore be inconvenient. Furthermore, such units can create a safety hazard if a person's foot should be positioned between the stair treads as the unit is moving towards a ramp configuration.

BRIEF SUMMARY OF THE INVENTION

Accordingly it is an object of the invention to provide a convertible dock ramp which can be locked in a stair configuration or a ramp configuration.

It is another object of the invention to provide a convertible dock ramp which can be remotely switched from a stair configuration to a ramp configuration.

It is yet another object of the invention to provide a convertible dock ramp which avoids injury to users' feet.

These and other objections are met by the present invention, which in one embodiment provides a convertible dock ramp having an upper end for being pivotally mounted to a mounting structure, and a lower end for resting on a second structure, the convertible dock ramp includes: a pair of spaced-apart side frames each including substantially parallel upper and lower rails; and a plurality of steps each including a tread surface, the steps pivotally mounted between the side frames such that the tread surfaces are maintained substantially parallel to each other as the side frames pivot about the upper end. The steps are pivotable between: a ramp configuration in which the tread surfaces collectively form a substantially flat ramp surface; and a stair configuration in which the tread surfaces collectively form a staircase-like structure. A changeover mechanism selectively retains the convertible dock ramp in the ramp configuration or the stair configuration.

According to another embodiment of the invention, the upper rails are mounted for pivotal motion about upper ends thereof, relative to the mounting structure, at a first hinge point. The upper and lower rails are moveable between: a first position in contact with the upper rails such that the tread surfaces are in the ramp configuration; and a second position spaced away from the upper rails such that the tread surfaces are in the stair configuration.

According to another embodiment of the invention, the lower rails are mounted for pivotal motion about upper ends thereof, relative to the mounting structure, at a second hinge point; and the changeover mechanism includes: a lock bar slidably mounted relative to the mounting structure, for movement between: a retracted position in which the upper and lower rails are allowed to move to the first position; and an extended position in which the upper and lower rails are forced to the second position.

According to another embodiment of the invention, the convertible dock ramp further includes a control lever pivotably attached to the lock bar such that pivoting motion of the control lever causes sliding motion of the lock bar.

According to another embodiment of the invention, the convertible dock ramp further includes means for retaining the control lever in a desired position.

According to another embodiment of the invention, the lower rails are mounted for pivotal motion about upper ends thereof, relative to the mounting structure, at a second hinge point; and the changeover mechanism includes: a hinge rod extending laterally between the upper ends of the lower rails; a laterally-extending control shaft carrying a radially-extending control arm, the control shaft pivotably mounted relative to the mounting structure, for movement between: a released position in which the control arm allows the upper and lower rails to move to the first position; and an extended position in which the control arm upper bears against the hinge rod to force the upper and lower rails are forced to the second position.

According to another embodiment of the invention, the convertible dock ramp further includes a lock arm having a hook, the lock arm pivotally mounted on one of the upper or lower rails so as to selectively engage a protruding stud disposed on the other of the upper and lower rails, such that the rails are locked in the first position.

According to another embodiment of the invention, the changeover mechanism includes: an actuator extending between the upper and lower rails, the actuator selectively moveable between: a retracted position in which the upper and lower rails are disposed in the first position; and an extended position in which the upper and lower rails are forced to the second position.

According to another embodiment of the invention, the actuator is electrically powered.

According to another embodiment of the invention, the actuator resists deviation from a selected position when electrical power is removed from the actuator.

According to another embodiment of the invention, the convertible dock ramp of claim 9 further includes: a battery operably connected to the actuator for supplying electric power thereto; and a solar cell operably connected to the battery for charging the battery.

According to another embodiment of the invention, the convertible dock ramp of further includes: a first switch disposed near an upper end of the convertible dock ramp and operably connected to the actuator for controlling motion of the actuator between the retracted and extended positions; and a second switch disposed near a lower end of the convertible dock ramp and operably connected to the actuator for controlling motion of the actuator between the retracted and extended positions.

According to another embodiment of the invention, each of the steps includes: a substructure adapted to be pivotably attached to the side frames; and a plate defining the tread surface pivotably attached to the substructure such that: the plate is supported by the substructure when a downward force is applied thereto, and the plate pivots freely away from the substructure when an upward force is applied thereto.

According to another embodiment of the invention, a convertible dock ramp has an upper end for being pivotally mounted to a mounting structure, and a lower end for resting on a second structure. The convertible dock ramp includes: a pair of spaced-apart side frames each including substantially parallel upper and lower rails; and a plurality of steps each including a tread surface, the steps pivotally mounted between the side frames such that the tread surfaces are maintained substantially parallel to each other as the side frames pivot about the upper end, the steps further being pivotable between: a ramp configuration in which the tread surfaces collectively form a substantially flat ramp surface; and a stair configuration in which the tread surfaces collectively form a staircase-like structure. Each of the steps includes: a substructure adapted to be pivotably attached to the side frames; and a plate defining the tread surface pivotably attached to the substructure such that: the plate is supported by the substructure when a downward force is applied thereto, and the plate pivots freely away from the substructure when an upward force is applied thereto.

According to another embodiment of the invention, each of the step substructures includes a pair of spaced-apart side plates connected by a laterally-extending cross bar.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
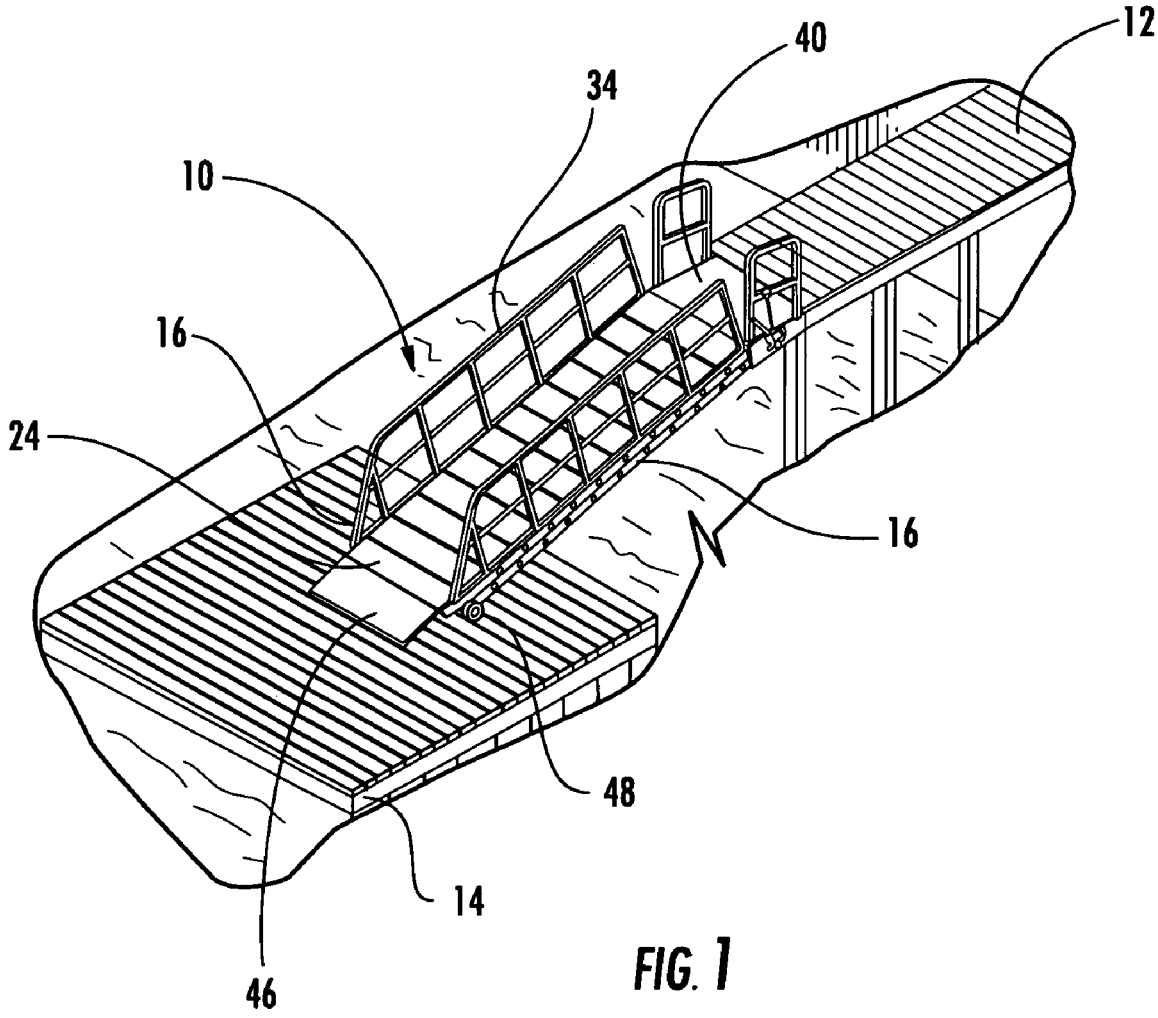
FIG. 1 is a perspective view of a convertible dock ramp constructed in accordance with the present invention.

Referring to the drawings wherein identical reference numerals denote the same elements throughout the various views, FIGS. 1–6 depict an exemplary convertible dock ramp 10, which is shown mounted between a fixed pier 12 and a floating dock 14. It is noted that the dock ramp 10 may be used to bridge any two structures. For example, it may be mounted between two floating docks of different heights, or between a ship and a fixed dock. The convertible dock ramp 10 includes a pair of spaced-apart side frames 16, each of which includes an upper rail 18 and a lower rail 20. A plurality of steps 22 are mounted between the side frames 16. Each step 22 includes a plate 24 defining a tread surface 26, and a pair of downwardly-extending end frames 28. Each end frame 28 is attached to one of the upper rails at an upper pivot 30, and to one of the lower rails 20 at a lower pivot 32. When all of the steps 22 are connected to the side frames 16, the entire assembly forms a unit adjustable such that the plates 24 always remain parallel to each other as the entire unit pivots, or as the upper and lower rails 18 and 20 move towards or away from each other. A handrail 34 of a conventional type is carried by the side frames 16.

The upper ends of each of the upper rails 18 are pivotably mounted to the fixed pier 12 at first hinge points 36, and the upper ends of the lower rails are attached to the pier 12 at second hinge points 38. It should be noted that the side frames 16 may be directly attached to the pier 12, or they may be attached to an upper landing platform 40 having spaced-apart side members 42 which is in turn mounted to the pier 12 without affecting the operation of the convertible dock ramp 10. In either case, the pier 12 or the landing platform 40 forms a mounting structure for the convertible dock ramp 10 which is relatively stationary (that is, not pivotable relative to the outside environment). In the illustrated example, the second or lower hinge points 38 comprise upright slots 39 which receive hinge pins 44 carried by the lower rails 20, and thus allow the lower rails 20 to both pivot and translate relative to the pier 12. The lower ends of the lower rails 20 rest on the floating dock 14. A hinged dock board 46 may be provided to ease the transition between the convertible dock ramp 10 and the dock 14. In the illustrated example, one or more rollers 48 allow the convertible dock ramp 10 to freely translate relative to the dock 14.

Figure 2:
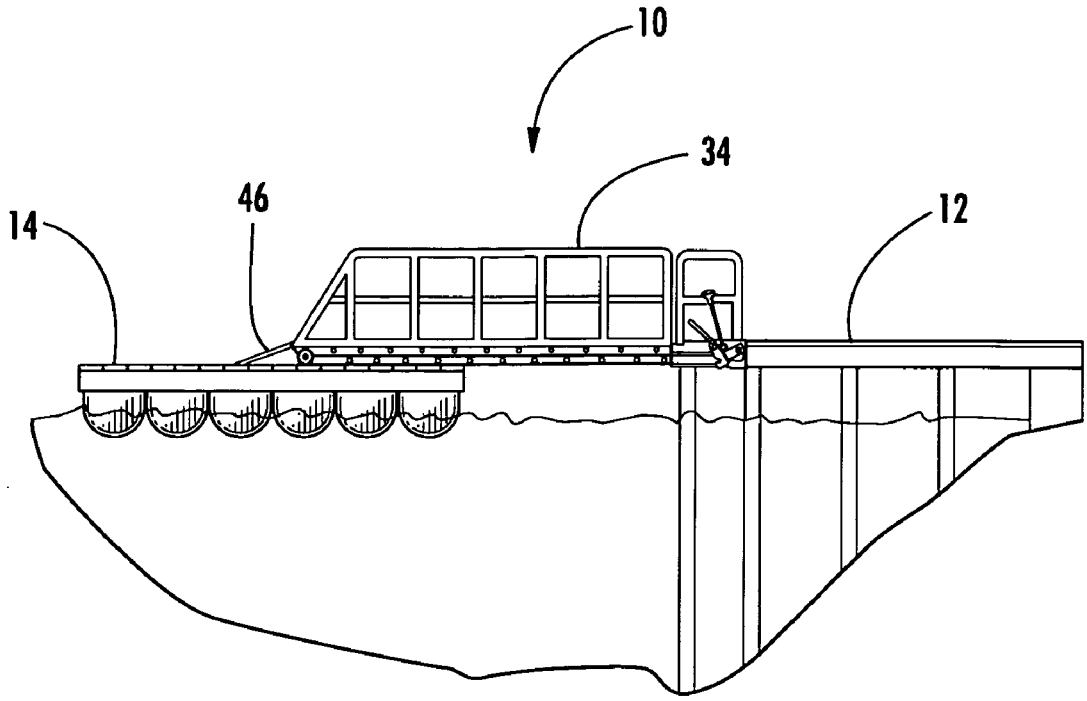
FIG. 2 is a side view of the convertible dock ramp of FIG. 1 in a ramp configuration.
Figure 3:
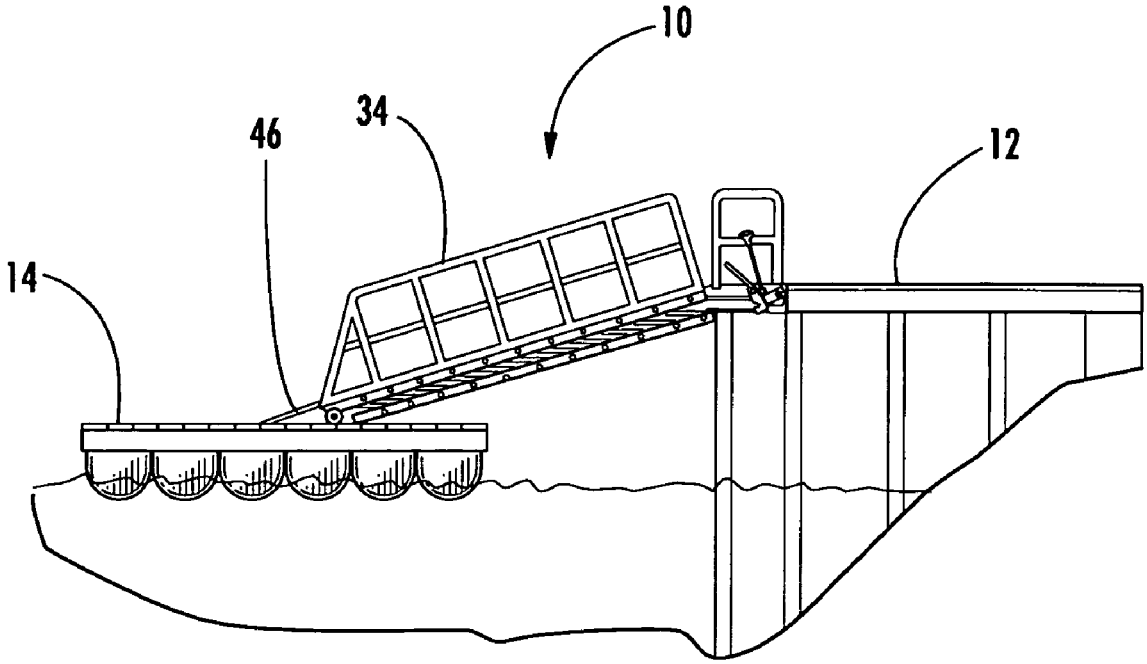
FIG. 3 is a side view of the convertible dock ramp of FIG. 1 in a partially extended stair configuration.
Figure 4:
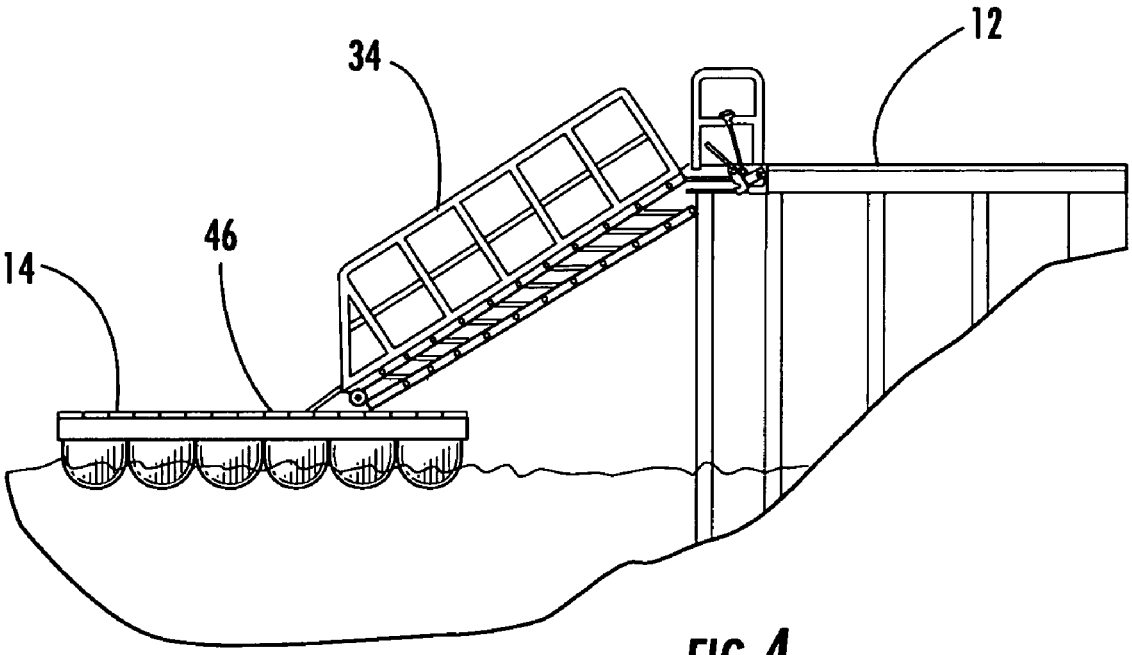
FIG. 4 is a side view of the convertible dock ramp of FIG. 1 in a fully extended stair configuration.
Figure 5:
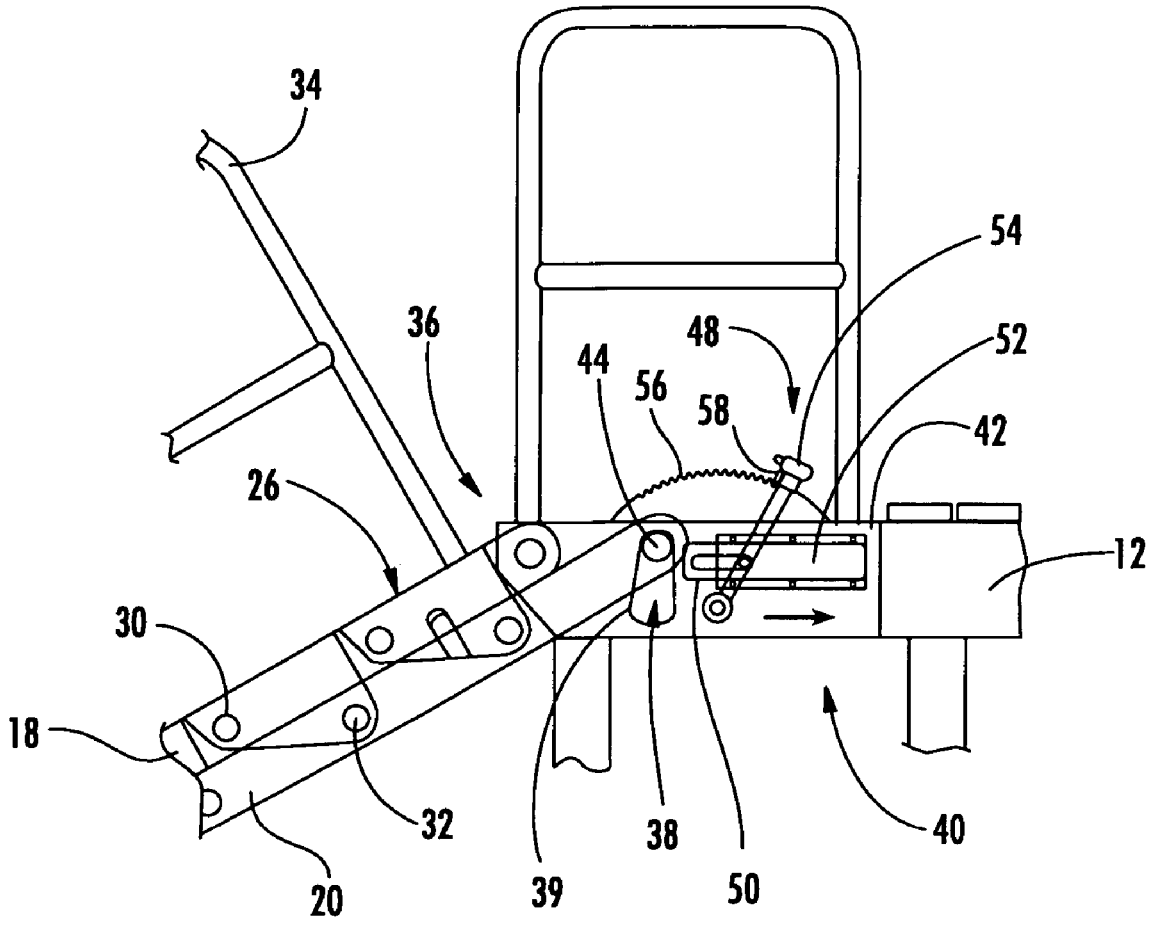
FIG. 5 is a side view of a portion of the convertible dock ramp of FIG. 1 showing a changeover mechanism thereof in a ramp configuration.
Figure 6:
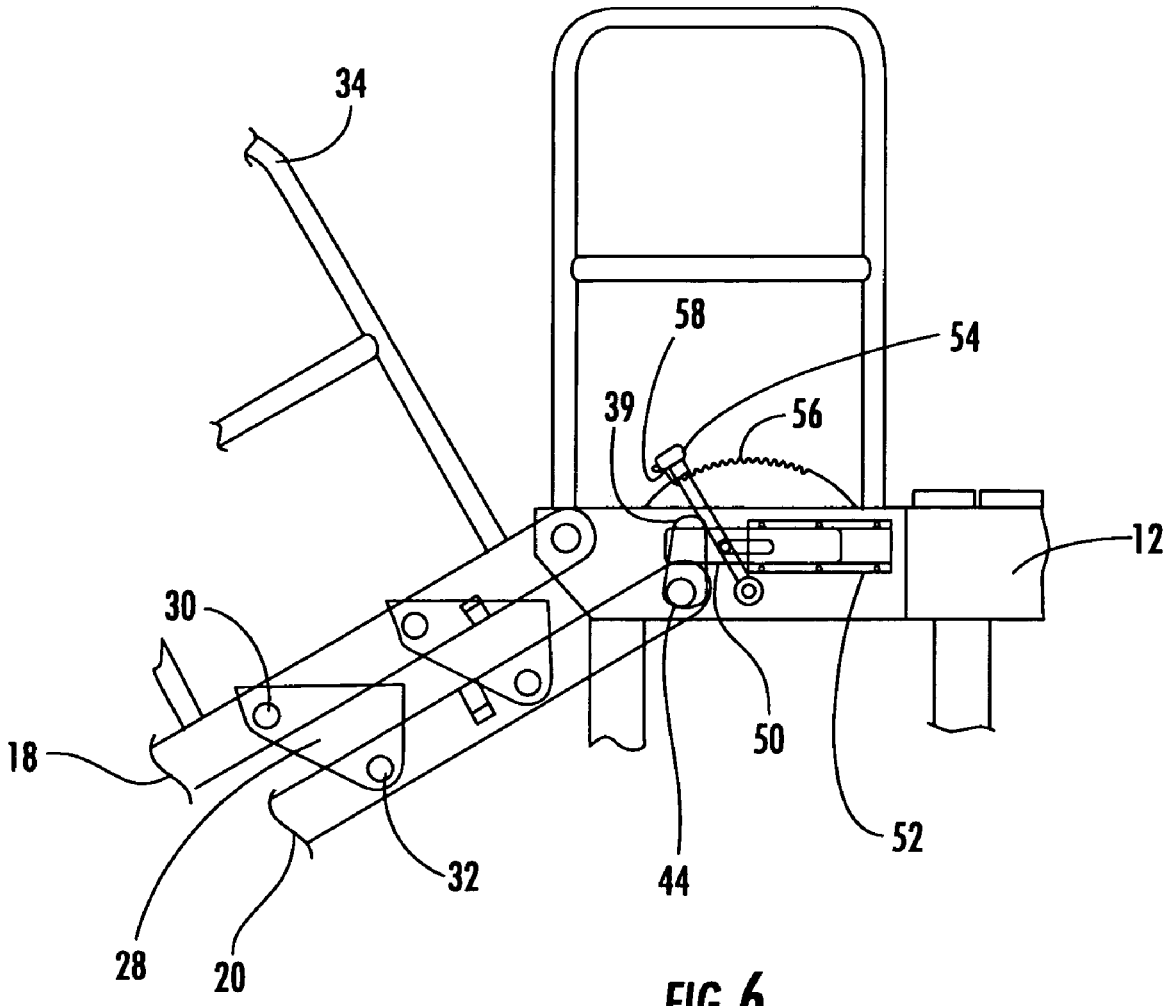
FIG. 6 is a side view of a portion of the convertible dock ramp of FIG. 1, showing a changeover mechanism thereof in a stair configuration.

The convertible dock ramp 10 has two basic configurations. When the upper and lower rails 18 and 20 are in contact, the tread surfaces 28 form a continuous, substantially planar ramp or walkway, as shown in FIGS. 2 and 5. The entire convertible dock ramp 10 can pivot up or down about the first and second hinge points 36 and 38 to accommodate changes in height between the dock 14 and the pier 12. This is considered a "ramp configuration". When the upper and lower rails 18 and 20 are separated, the tread surfaces 26 are held in a parallel, spaced-apart relationship so they may be climbed like a staircase. The tread surfaces 26 pivot to remain parallel as the entire convertible dock ramp 10 pivots up or down relative to the pier 12. Accordingly, when the convertible dock ramp 10 is near horizontal, a rise dimension between the tread surfaces 26 is relatively small, and when the convertible dock ramp 10 is angled more steeply, the rise dimension is relatively larger. This is considered a "stair configuration". FIG. 3 depicts a partially extended stair configuration, while FIGS. 4 and 6 depicts a full stair configuration.

A changeover mechanism 48 allows a user to selectively determine whether the convertible dock ramp is in the ramp configuration or the stair configuration. In the example illustrated in FIGS. 5 and 6, the changeover mechanism 48 comprises a lock bar 50 slidably mounted in a housing 52 and pivotably connected to a control lever 54. When the lock bar 50 is retracted, as shown in FIG. 5, it allows the hinge pins 44 to move upwards in the slot 39, bringing the upper and lower rails 18 and 20 together under upwards pressure from the floating dock 14 and placing the convertible dock ramp 10 in the ramp configuration. When the lock bar 50 is extended, as shown in FIG. 6, it holds the hinge pins 44 down in the bottom of the slots 39, placing the convertible dock ramp 10 in the stair configuration. In either case, unintended switchover of the configuration is prevented. Lock means such as the illustrated gear sector 56 and cooperating lock pawl 58 are provided to keep the control lever 54 in the desired position.

Figure 7:
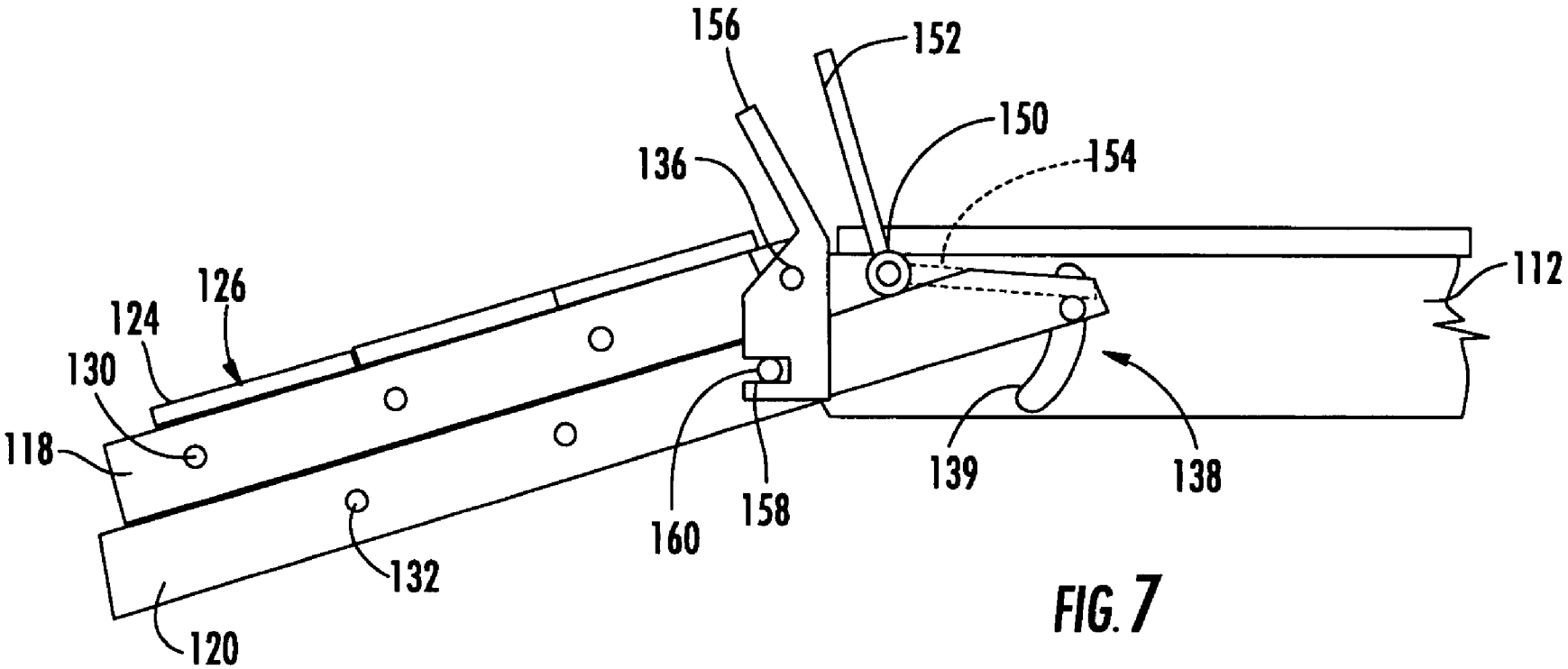
FIG. 7 is a side view of an alternative convertible dock ramp showing a changeover mechanism thereof in a ramp configuration.
Figure 8:
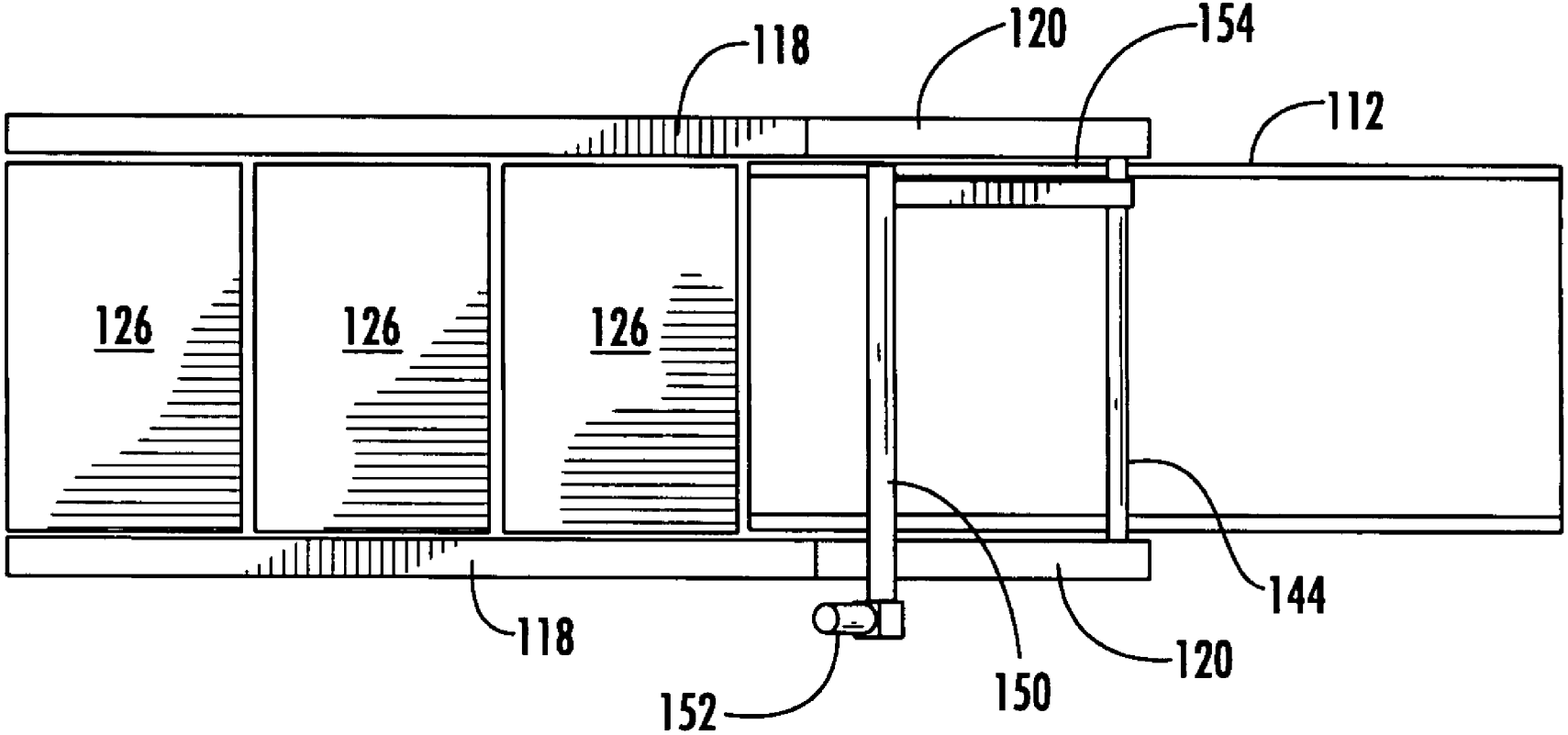
FIG. 8 is a top view of the dock ramp of FIG. 7.
Figure 9:
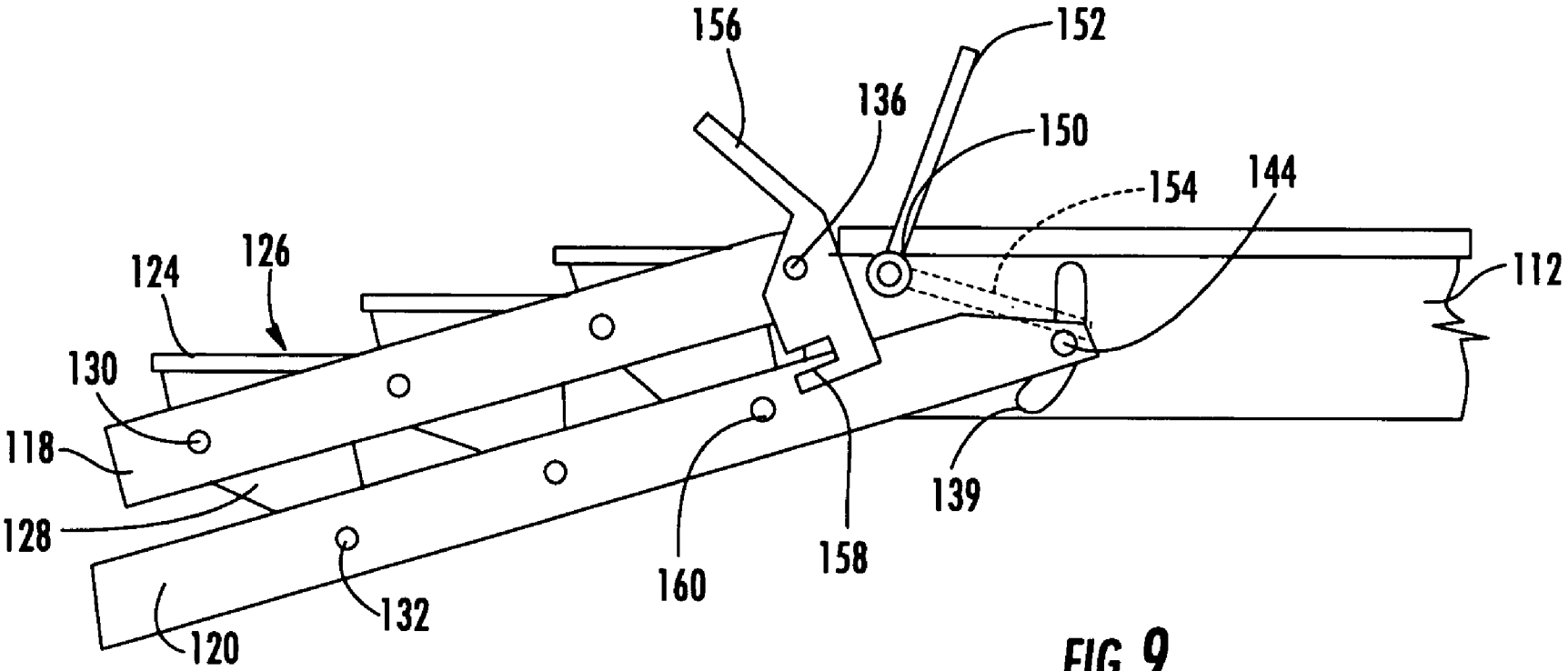
FIG. 9 is a side view of the convertible dock ramp of FIG. 7 in a stair configuration.

FIGS. 7–9 depict an alternative convertible dock ramp 110, which is substantially identical to the convertible dock ramp 10 except for the method of selecting the configuration. The basic elements of the convertible dock ramp 110 are a pair of spaced-apart side frames 116, each of which includes an upper rail 118 and a lower rail 120. A plurality of steps 122 are mounted between the side frames 116. Each step 122 includes a plate 124 defining a tread surface 126, and a pair of downwardly-extending end frames 128. Each end frame 128 is attached to one of the upper rails at an upper pivot 130, and to one of the lower rails 120 at a lower pivot 132.

The upper ends of each of the upper rails 118 are attached to a fixed pier 112 or other relatively stationary structure at first or upper hinge points 136, and the upper ends of the lower rails 120 are attached to the pier 112 at second or lower hinge points 138. In the illustrated example, the lower hinge points 138 comprise upright slots 139 which receive a transversely-extending hinge rod 144 carried by the lower rails 120, and thus allow the lower rails 120 to both pivot and translate relative to the pier 112. FIG. 8 shows the pier with the planking surface removed so that the hinge rod 144 is visible.

A changeover mechanism 148 comprises a control shaft 150 pivotably mounted relative to the pier 112. A first end of the control shaft 150 carries a control lever 152, and a second end of the control shaft 150 carries a control arm 154. When the control arm 154 is raised by rotating the control lever 152 towards the convertible dock ramp 110 as shown in FIG. 7, it allows the hinge rod 144 to move upwards in the slots 139, bringing the upper and lower rails 118 and 120 together under upwards pressure from the floating dock (not shown) and placing the convertible dock ramp 110 in the ramp configuration. When the control arm 154 is lowered by rotating the control lever 152 away from the convertible dock ramp 110, as shown in FIG. 9, it forces the hinge rod 144 down in the bottom of the slots 139, placing the convertible dock ramp 110 in the stair configuration. In either case, unintended switchover of the configuration is prevented. Lock means such as the illustrated pivoting lock arm 156 may be provided. The lock arm 156 has a hook 158 which can selectively engage a protruding stud 160 on the lower rail 120, which could be part of one of the lower pivots 132, to keep the convertible dock ramp 110 in the ramp configuration.

Figure 10:
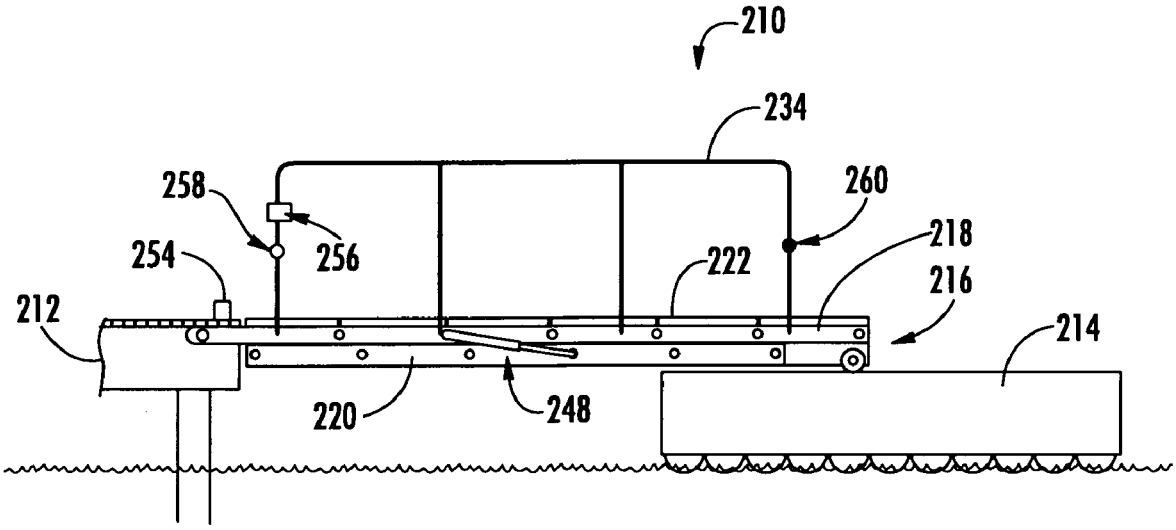
FIG. 10 is a side view of another alternative convertible dock ramp in a ramp configuration.
Figure 11:
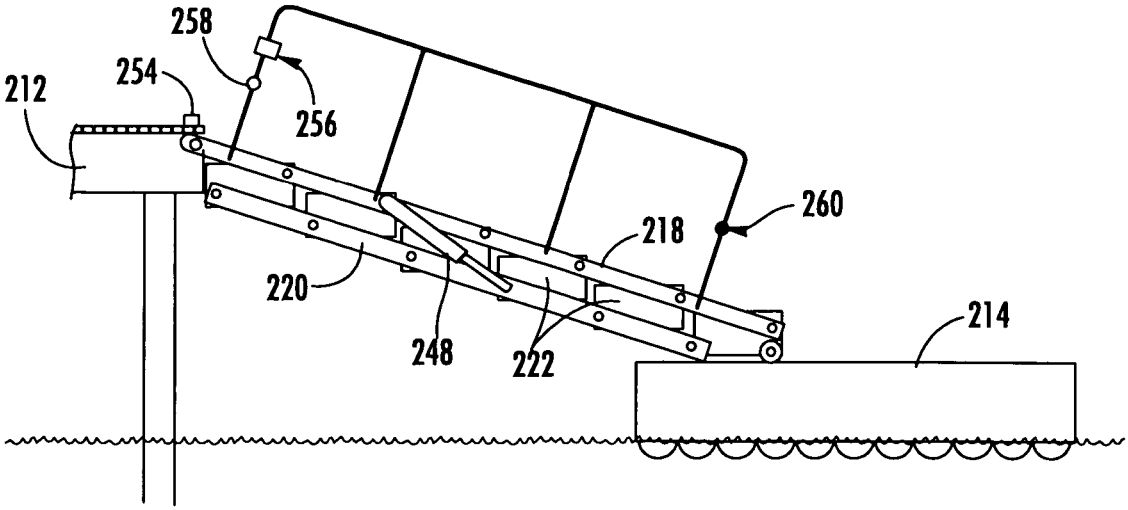
FIG. 11 is a side view of the convertible dock ramp of FIG. 10 in a stair configuration.
Figure 12:
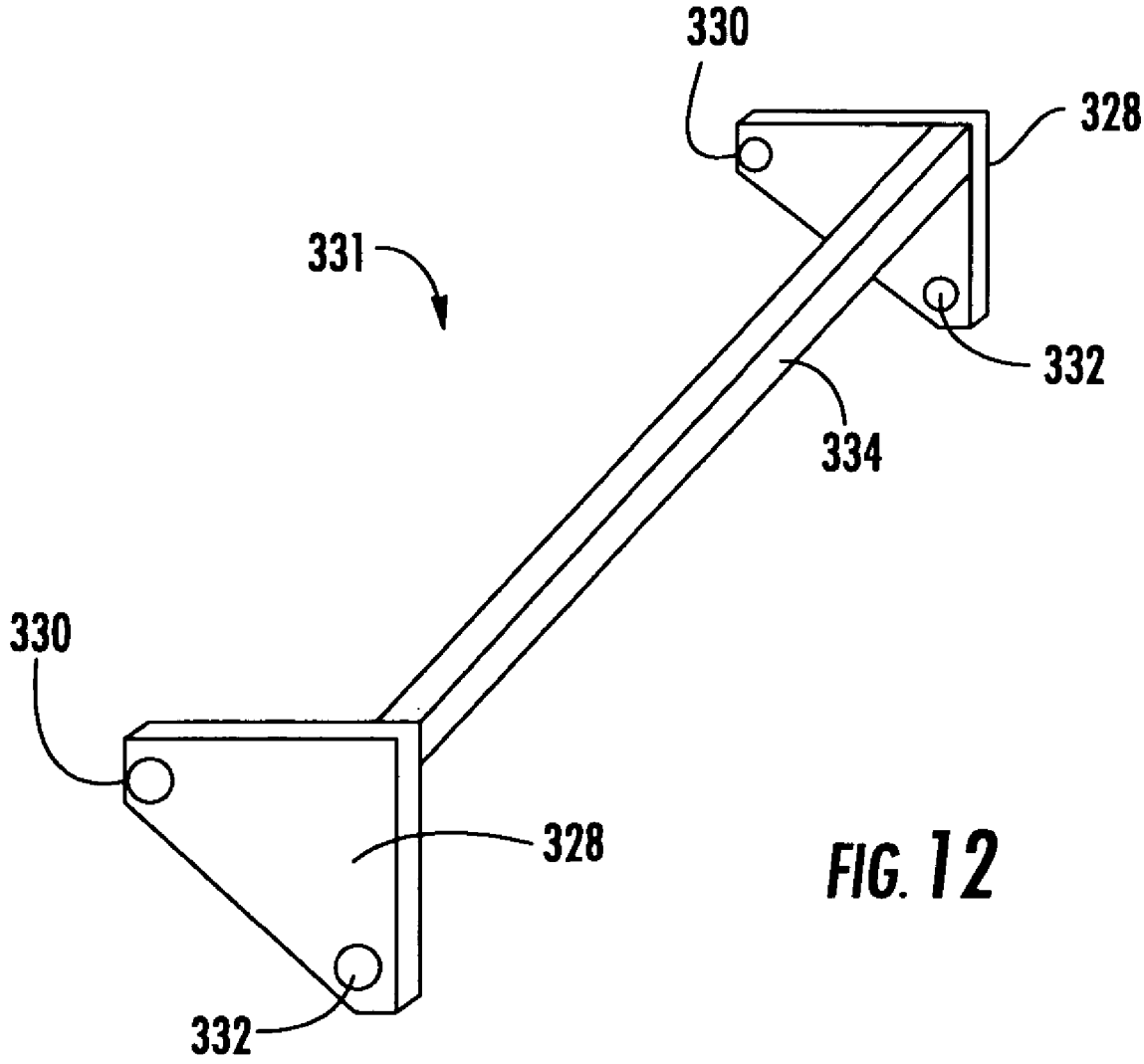
FIG. 12 is a perspective view of a step substructure.
Figure 13:
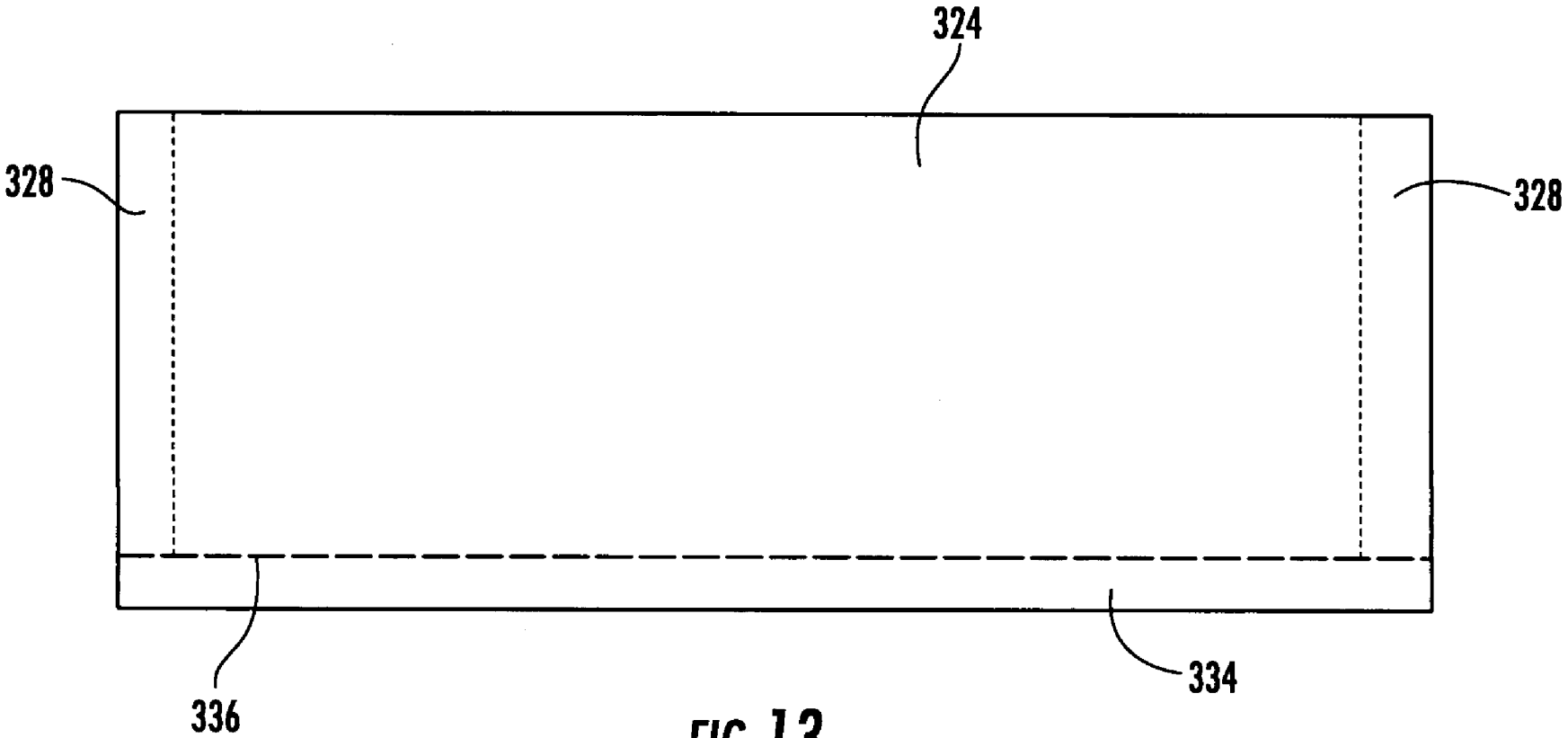
FIG. 13 is a top view of a step incorporating the substructure of FIG. 12.

FIGS. 10 and 11 illustrates another alternative convertible dock ramp 210. The convertible dock ramp 210 is substantially similar in overall construction to the convertible dock ramp 10 and includes a plurality of steps 222 pivotally mounted between spaced-apart side frames 216 (only one of which is shown in FIG. 10), each comprising upper and lower rails 218 and 220. A handrail 234 is also provided. An actuator 248 has a first end 250 pivotally mounted to the upper rail 218, and a second end 252 pivotally mounted to the lower rail 220. Any actuator which is capable of changing its effective length may be used for this purpose. In the illustrated example, the actuator 248 is an DC electric-powered combination motor and ball screw unit of the type used as a hatch lift in marine applications and available from Lenco Marine Inc., Stuart, Fla. 34997 USA. An electric power source of a known type is provided for the actuator 248. In the illustrated example, the power source comprises a battery 254 and a solar cell 256, connected with appropriate wiring (not shown) so that the solar cell 256 can charge the battery 254, and the battery 254 can provide operating current to the actuator 248. With this arrangement, the convertible dock ramp 210 is self-contained and requires no connections to an outside power source.

Appropriate controls are provided for the actuator 248. In the illustrated example, an upper switch 258 is mounted near the fixed pier 212 to which the convertible dock ramp 210 is mounted, and a lower switch 260 is mounted near the floating dock 214 on which the lower end of the convertible dock ramp 210 rests. The switches 258 and 260 are connected such that they can independently control the position of the actuator 248. This greatly improves the convenience in using the convertible dock ramp 210. For example, If a user departs the dock 214 in a boat and then returns several hours later, after the tide level has changed significantly, the convertible dock ramp 210 may be in the "stairs" configuration when the "ramp" configuration is desired. The lower switch 260 provides the ability to reconfigure the convertible dock ramp 210 without having to leave the dock 214. If desired, the convertible dock ramp 210 could also be provided with a wireless remote of a known type to control the actuator 248. When the actuator 248 is retracted, it forces the upper and lower rails 218 and 220 together into a ramp configuration, as shown in FIG. 10 When the actuator 248 is extended, it drives the upper and lower rails 218 and 220 apart into a stair configuration. The use of an irreversible or self-locking actuator 248 prevents unintentional changeover of the configuration.

Figure 14:
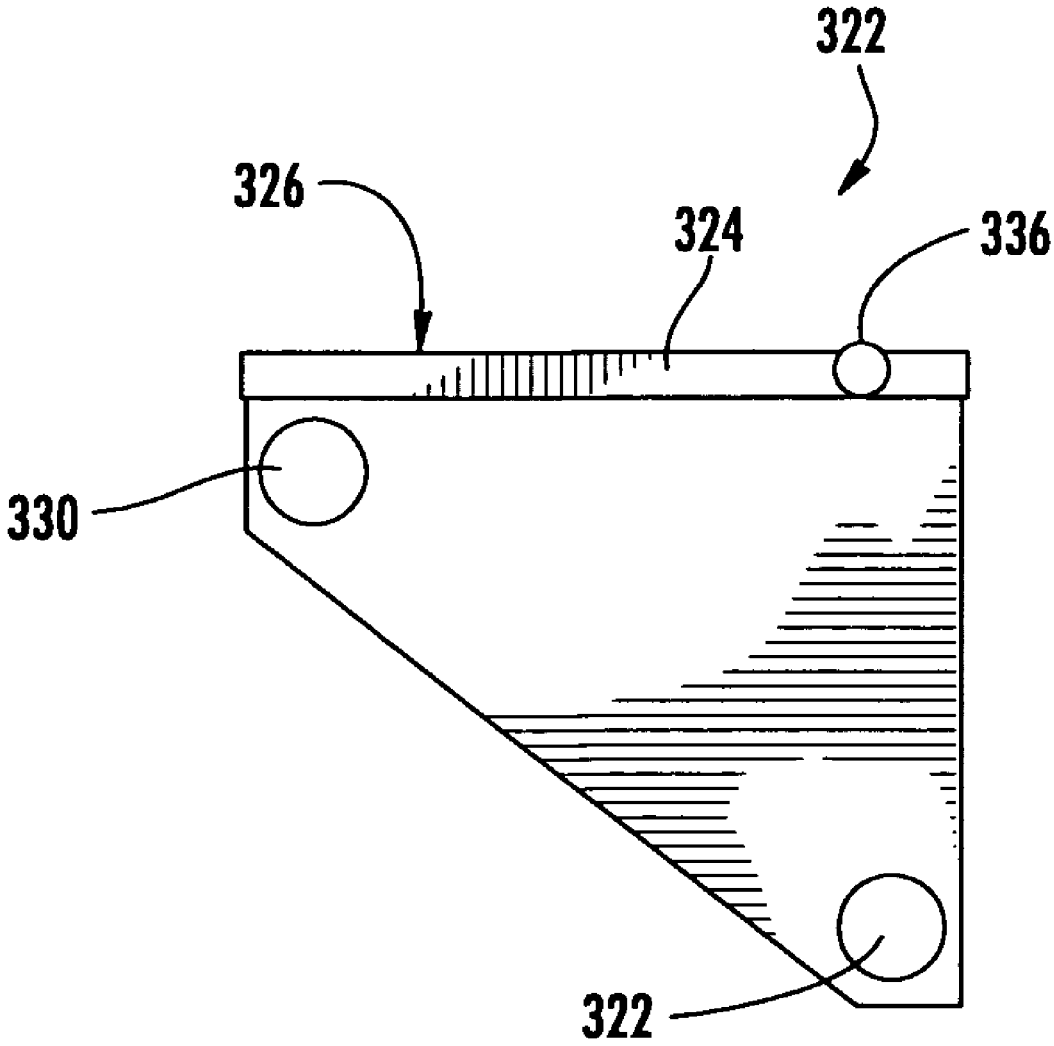
FIG. 14 is a side view of the step of FIG. 13 in a lowered position.
Figure 15:
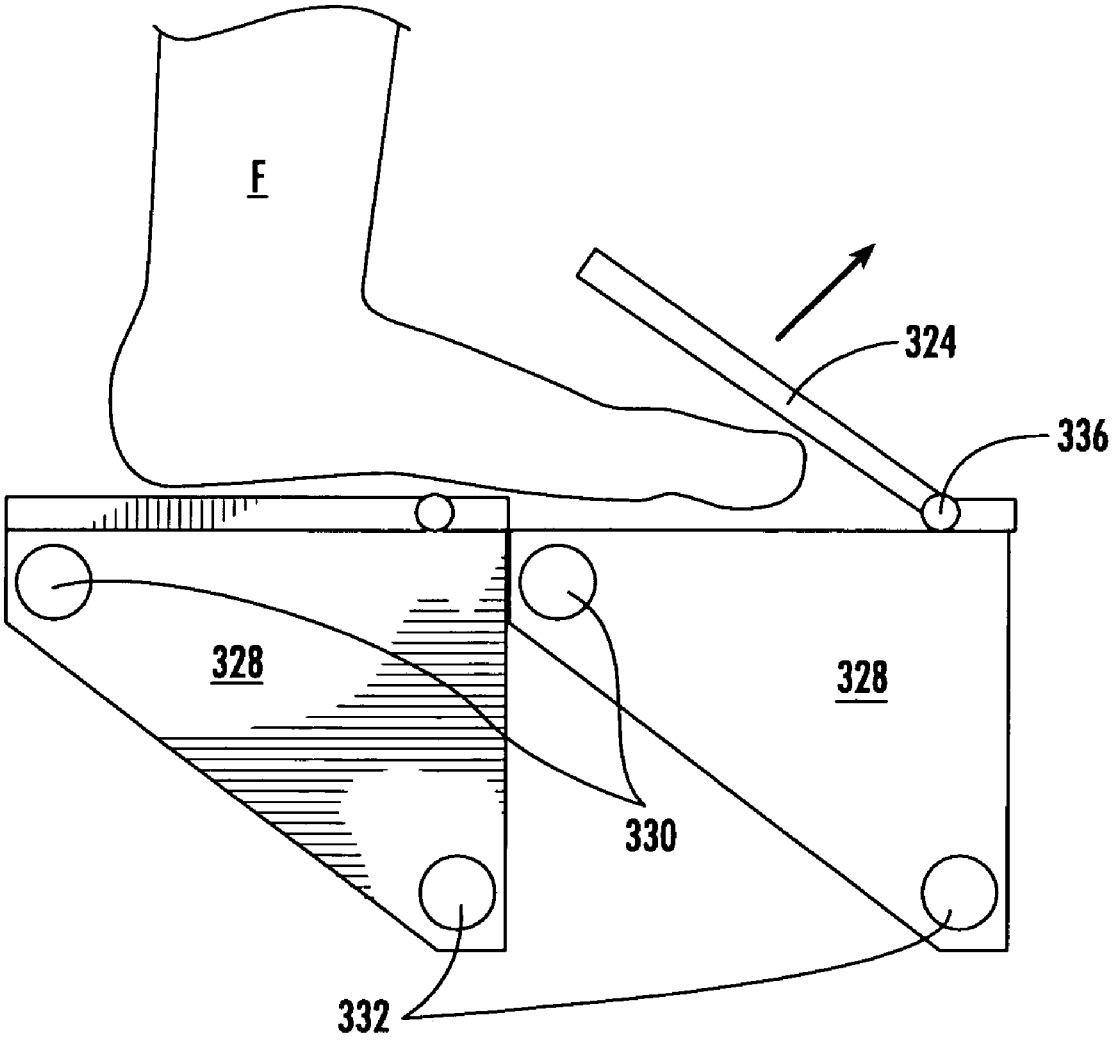
FIG. 15 is a side view of the step of FIG. 13 in a raised position.

FIGS. 12–15 illustrate an alternative step 322 which may be substituted for any of the steps 22, 122, or 222 described above. Each step 322 includes a pair of downwardly-extending end frames 328, each having upper and lower pivots 330 and 332, respectively, for attachment to the upper and lower rails described above. A crossbar 334 extends between the end frames 328 to form a complete substructure 331. A plate 324 defining a tread surface 326 is pivotally mounted to the crossbar 334 and/or end frames 328, for example using the illustrated continuous piano-type hinge 336. When weight is place on top of the tread surface 326, the plate 324 is supported by the end frames 328, as shown in FIG. 14. However, when upward force is applied to the plate 324, it can freely hinge upwards. This acts as a safety feature which prevents a person's foot, labeled "F" in FIG. 15, from becoming trapped underneath the plate 324 when the convertible dock ramp pivots from a stair configuration to a ramp configuration.

The foregoing has described a convertible dock ramp. While specific embodiments of the present invention have been described, it will be apparent to those skilled in the art that various modifications thereto can be made without departing from the spirit and scope of the invention. Accordingly, the foregoing description of the preferred embodiment of the invention and the best configuration for practicing the invention are provided for the purpose of illustration only and not for the purpose of limitation.

What is claimed is:

1. A convertible dock ramp having an upper end for being pivotally mounted to a mounting structure, and a lower end for resting on a second structure, said convertible dock ramp comprising:

a pair of spaced-apart side frames each including substantially parallel upper and lower rails; and a plurality of steps each including a tread surface, said steps pivotally mounted between said side frames such that said tread surfaces are maintained substantially parallel to each other as said side frames pivot about said upper end, said steps further being pivotable between:

a ramp configuration in which said tread surfaces collectively form a substantially flat ramp surface; and a stair configuration in which said tread surfaces collectively form a staircase-like structure; and a changeover mechanism for retaining said steps in a selected one of said ramp configuration and said stair configuration, while allowing said dock ramp to pivot about said upper end regardless of whether said steps are in said ramp configuration or said stair configuration, and further allowing said steps to pivot to remain substantially parallel to each other as said side frames pivot about said upper end, when said steps are in said stair configuration.

2. The convertible dock ramp of claim 1 in which:

said upper rails are mounted for pivotal motion about upper ends thereof, relative to said mounting structure, at a first hinge point; and said upper and lower rails are moveable between:

a first position with said upper rails and said lower rails are in contact such that said tread surfaces are in said ramp configuration; and a second position with said lower rails spaced away from said upper rails such that said tread surfaces are in said stair configuration.

3. The convertible dock ramp of claim 2 in which said lower rails are mounted for pivotal motion about upper ends thereof, relative to said mounting structure, at a second hinge point; and in which said changeover mechanism comprises:

a lock bar slidably mounted relative to said mounting structure, for movement between:

a retracted position in which said upper and lower rails are allowed to move to said first position; and an extended position in which said upper and lower rails are forced to said second position.

4. The convertible dock ramp of claim 3 further comprising a control lever pivotably attached to said lock bar such that pivoting motion of said control lever causes sliding motion of said lock bar.

5. The convertible dock ramp of claim 4 further comprising means for retaining said control lever in a desired position.

6. The convertible dock ramp of claim 2 in which said lower rails are mounted for pivotal motion about upper ends thereof, relative to said mounting structure, at a second hinge point; and said changeover mechanism comprises:

a hinge rod extending laterally between said upper ends of said lower rails;

a laterally-extending control shaft carrying a radially-extending control arm, said control shaft pivotably mounted relative to said mounting structure, for movement between:

a released position in which said control arm allows said upper and lower rails to move to said first position; and an extended position in which said control arm upper bears against said hinge rod to force said upper and lower rails to said second position.

7. The convertible dock ramp of claim 6 further comprising a lock arm having a hook, said lock arm pivotally mounted on one of said upper or lower rails so as to selectively engage a protruding stud disposed on the other of said upper and lower rails, such that said rails are locked in said first position.

8. The convertible dock ramp of claim 2 in which said changeover mechanism comprises:

an actuator extending between said upper and lower rails, said actuator selectively moveable between:

a retracted position in which said upper and lower rails are disposed in said first position; and a extended position in which said upper and lower rails are forced to said second position.

9. The convertible dock ramp of claim 8 in which said actuator is electrically powered.

10. The convertible dock ramp of claim 9 in which said actuator resists deviation from a selected position when electrical power is removed from said actuator.

11. The convertible dock ramp of claim 9 further comprising:

a battery operably connected to said actuator for supplying electric power thereto; and a solar cell operably connected to said battery for charging said battery.

12. The convertible dock ramp of claim 10 further comprising:

a first switch disposed near an upper end of said convertible dock ramp and operably connected to said actuator for controlling motion of said actuator between said retracted and extended positions; and a second switch disposed near a lower end of said convertible dock ramp and operably connected to said actuator for controlling motion of said actuator between said retracted and extended positions.

13. The convertible dock ramp of claim 1 wherein each of said steps includes:

a substructure adapted to be pivotably attached to said side frames; and a plate defining said tread surface pivotably attached to said substructure such that:

said plate is supported by said substructure when a downward force is applied thereto, and said plate pivots freely away from said substructure when an upward force is applied thereto.

14. A convertible dock ramp having an upper end for being pivotally mounted to a mounting structure, and a lower end for resting on a second structure, said convertible dock ramp comprising:

a pair of spaced-apart side frames each including substantially parallel upper and lower rails; and a plurality of steps each including a tread surface, said steps pivotally mounted between said side frames such that said tread surfaces are maintained substantially parallel to each other as said side frames pivot about said upper end, said steps further being pivotable between:

a ramp configuration in which said tread surfaces collectively form a substantially flat ramp surface; and a stair configuration in which said tread surfaces collectively form a staircase-like structure;

wherein each of said steps includes:

a substructure adapted to be pivotably attached to said side frames; and a plate defining said tread surface pivotably attached to said substructure such that:

said plate is supported by said substructure when a downward force is applied thereto, and said plate pivots freely away from said substructure when an upward force is applied thereto.

15. The convertible dock ramp of claim 14 wherein of said step substructures includes a pair of spaced-apart side plates connected by a laterally-extending crossbar.

16. The convertible dock ramp of claim 14 further including a changeover mechanism for selectively retaining said convertible dock ramp in said ramp configuration or said stair configuration.

17. The convertible dock ramp of claim 16 in which:

said upper rails are mounted for pivotal motion about upper ends thereof, relative to said mounting structure, at a first hinge point;

said upper and lower rails are moveable between:

a first position in contact with said upper rails such that said tread surfaces are in said ramp configuration; and a second position spaced away from said upper rails such that said tread surfaces are in said stair configuration.

18. The convertible dock ramp of claim 16 in which said lower rails are mounted for pivotal motion about upper ends thereof, relative to said mounting structure, at a second hinge point; and in which said changeover mechanism comprises:

a lock bar slidably mounted relative to said mounting structure, for movement between:

a retracted position in which said upper and lower rails are allowed to move to said first position; and an extended position in which said upper and lower rails are forced to said second position.

19. The convertible dock ramp of claim 18 in further comprising a control lever pivotably attached to said lock bar such that pivoting motion of said control lever causes sliding motion of said lock bar.

20. The convertible dock ramp of claim 19 further comprising means for retaining said control lever in a desired position.

21. The convertible dock ramp of claim 16 in which said lower rails are mounted for pivotal motion about upper ends thereof, relative to said mounting structure, at a second hinge point; and said changeover mechanism comprises:

a hinge rod extending laterally between said upper ends of said lower rails;

a laterally-extending control shaft carrying a radially-extending control arm, said control shaft pivotably mounted relative to said mounting structure, for movement between:

a released position in which said control arm allows said upper and lower rails to move to said first position; and an extended position in which said control arm upper bears against said hinge rod to force said upper and lower rails are forced to said second position.

22. The convertible dock ramp of claim 21 further comprising a lock arm having a hook, said lock arm pivotally mounted on one of said upper or lower rails so as to selectively engage a protruding stud disposed on the other of said upper and lower rails, such that said rails are locked in said first position.

23. The convertible dock ramp of claim 16 in which said changeover mechanism comprises:

an actuator extending between said upper and lower rails, said actuator selectively moveable between:

a retracted position in which said upper and lower rails are disposed in said first position; and an extended position in which said upper and lower rails are forced to said second position.

24. The convertible dock ramp of claim 23 in which said actuator is electrically powered.

25. The convertible dock ramp of claim 24 in which said actuator resists deviation from a selected position when electrical power is removed from said actuator.

26. The convertible dock ramp of claim 24 further comprising:

a battery operably connected to said actuator for supplying electric power thereto; and a solar cell operably connected to said battery for charging said battery.

27. The convertible dock ramp of claim 24 further comprising:

a first switch disposed near an upper end of said convertible dock ramp and operably connected to said actuator for controlling motion of said actuator between said retracted and extended positions; and a second switch disposed near a lower end of said convertible dock ramp and operably connected to said actuator for controlling motion of said actuator between said retracted and extended positions.

* * * * *